US005553667A

United States Patent [19]

Budde et al.

[11] Patent Number: 5,553,667

[45] Date of Patent: Sep. 10, 1996

[54] CEMENTING SYSTEM

[75] Inventors: Peter Budde, Vlaardingen, Netherlands; Richard L. Giroux, Katy, Tex.

[73] Assignee: Weatherford U.S., Inc., Houston, Tex.

[21] Appl. No.: 429,763

[22] Filed: Apr. 26, 1995

[51] Int. Cl.[6] ..... E21B 33/05

[52] U.S. Cl. ..... 166/70; 166/73; 166/156

[58] Field of Search ..... 166/70, 73, 386, 166/381, 285, 153, 155, 156

[56] References Cited

U.S. PATENT DOCUMENTS

| | | | |
|---|---|---|---|
| 2,620,037 | 12/1952 | McClendon | 166/14 |
| 2,630,179 | 3/1953 | Brown | 166/155 |
| 3,545,542 | 12/1970 | Scott | 166/155 |
| 3,616,850 | 11/1971 | Scott | 166/155 |
| 3,635,288 | 1/1972 | Lebourg | 166/156 |
| 3,796,260 | 3/1974 | Bradley | 166/153 |
| 3,863,716 | 2/1975 | Streigch | 166/70 |
| 3,915,226 | 10/1975 | Savage | 166/73 |
| 3,926,253 | 12/1975 | Duke | 166/70 X |
| 4,047,566 | 9/1977 | Duke | 166/285 |
| 4,078,810 | 3/1978 | Arendt | 277/116.4 |
| 4,083,074 | 4/1978 | Curtis | 15/104.06 R |
| 4,164,980 | 8/1979 | Duke | 166/291 |
| 4,190,112 | 2/1980 | Davis | 166/291 |
| 4,246,967 | 1/1981 | Harris | 166/291 |
| 4,290,482 | 9/1981 | Brisco | 166/70 |
| 4,356,865 | 11/1982 | Appel et al. | 166/153 |
| 4,427,065 | 1/1984 | Watson | 166/250 |
| 4,429,746 | 2/1984 | Allard | 166/291 |
| 4,433,859 | 2/1984 | Driver et al. | 285/34 |
| 4,453,745 | 6/1984 | Nelson | 285/18 |
| 4,457,369 | 7/1984 | Henderson | 166/125 |
| 4,624,312 | 11/1986 | McMullin | 166/155 |
| 4,753,444 | 6/1988 | Jackson et al. | 277/230 |
| 4,809,776 | 3/1989 | Bradley | 166/153 |
| 4,836,279 | 6/1989 | Freeman | 166/153 |
| 4,858,687 | 8/1989 | Watson et al. | 166/153 |
| 4,934,452 | 6/1990 | Bradley | 166/153 |
| 4,986,361 | 1/1991 | Mueller et al. | 166/381 |
| 5,004,048 | 4/1991 | Bode | 166/70 |
| 5,078,211 | 1/1992 | Swineford | 166/202 |
| 5,095,980 | 3/1992 | Watson | 166/192 |
| 5,117,915 | 6/1992 | Mueller et al. | 166/381 |
| 5,178,216 | 1/1993 | Giroux et al. | 166/242 |
| 5,224,540 | 7/1993 | Streich et al. | 166/118 |
| 5,279,370 | 1/1994 | Brandell et al. | 166/386 |
| 5,413,172 | 5/1995 | Laurel | 166/153 |
| 5,435,390 | 7/1995 | Baugh et al. | 166/285 |
| 5,443,122 | 8/1995 | Brisco | 166/285 |

OTHER PUBLICATIONS

"Casing Sales Manual," Halliburton, Sections 3–5, 1993.
"Fasdrop Head," LaFleur Petroleum Services, Inc. 1992.

*Primary Examiner*—Frank Tsay
*Attorney, Agent, or Firm*—Guy McClung

[57] ABSTRACT

A new cementing system has been developed which includes, in certain embodiments, a plug container with a flow diverter for diverting a portion of flowing fluid away from plugs in the plug container; a plug set system with internal sleeves or dart receivers with shearable parts for shearing to selectively release plugs—all in certain embodiments made of non-metal material and/or plastic; and a swivel equalizer with internal valving to isolate a plug set (or any other item) from torque and to relieve pressure below the swivel equalizer.

20 Claims, 10 Drawing Sheets

CEMENTING SYSTEM

BACKGROUND OF THE INVENTION

1. Field of the Invention

This invention is directed to wellbore cementing systems; plug set release systems; plug containers; and swivel equalizers for well tools and apparatuses.

2. Description of Related Art

During the construction of oil and gas wells a bore is drilled into the earth. Casing is then lowered down the bore and the annular space between the outside of the casing and the bore is filled with cement. The casing is generally held centrally in the bore by centralizers which are mounted on the casing at spaced intervals therealong. Typically, a non-return valve known as a "float valve" is mounted on or adjacent the bottom of the casing. During a typical cementing operation the annular space is first cleared by pumping circulating fluid down the inside of the casing and allowing it to flow upwardly through the annular space. When the annular space is clean a bottom plug is placed in the casing. The bottom plug is pumped ahead of cement to separate the cement from drilling mud and other wellbore fluids. The bottom plug typically has wipers of elastomeric material to wipe mud from the casing so it does not contaminate the cement. When the plug reaches float equipment at the bottom of the casing string, a fluid pressure differential created across the plug ruptures a rupturable member of the plug and allows the cement to flow down the casing, through the plug and float equipment, and up into an annular space between the casing and the wellbore. When the cement flow ceases, a top cementing plug is released from the plug container. The top plug follows the cement and reduces contamination or channeling of the cement by drilling mud that is used to displace the cement column down the casing and into the annular space. The top cementing plug sealingly contacts the bottom cementing plug at the float equipment to effect a shut off of fluids being pumped into the casing. The return flow of cement back into the casing in inhibited by the float valve. When the cement has set the top plug, bottom plug, float valve and residual cement are drilled out.

Typically, plug containers or cementing heads connected to the upper end of the casing string releasably hold cementing plugs until they are to be released ahead of and behind the cement as it is displaced through the cementing head into the well casing. Many prior art plug set systems are complex with many moving parts, some of which are exposed to the corrosive fluids flowing up and down in the wellbore. In cementing offshore wells drilled beneath a body of water, the plugs may be run into the wellbore with a casing string. A variety of problems are associated with such "sub sea" release systems; e.g. parts are eroded by sand, grit, and corrosive material in various fluids; positive indication of plug release is not achieved; plugs or parts of them are not made of easily drillable material; and ocean forces on casing extending from a drilling platform to a sub-sea wellhead bend and twist the casing, inhibiting or preventing the use of certain plugs.

This has led to the development of sub-sea cementing apparatus which generally comprises an open top plug and an open bottom plug which are releasably connected to one another. In use, the sub-sea cementing apparatus is positioned in the casing at or adjacent the sub-sea wellhead by a tool string. Circulating fluid is then pumped downwardly from the drilling platform through the tool string, the open top plug, the open bottom plug and the casing and flows upwardly through the annular space between the outside of the casing and the bore. This operation is typically carried out for several hours after which a first closure member, typically a ball or a dart, is dropped down the casing, passes through the top plug but closes the bottom plug. A required volume of cement is then pumped down from the drilling platform. This detaches the bottom plug from the top plug and forces the bottom plug to slide down the casing. Once the required volume of cement has been pumped into the casing a second closure member, typically a ball or a dart of larger diameter than the first dart is placed on the top of the cement and pumped down with drilling fluid. When the second closure member engages the top plug it closes the opening therein and further pressure from the drilling fluid releases the top plug down the casing. When the bottom plug engages the float valve at the bottom of the casing the pressure on the top plug is increased until a rupturable member in the bottom plug ruptures allowing the cement to pass through the float valve into the annular space between the outside of the casing and the bore. When the top plug engages the bottom plug the hydraulic pressure on the drilling fluid is released and the cement allowed to set after which the top plug, bottom plug, float valve and residual cement are drilled out.

The disadvantage with existing sub-sea equipment is that it has been extremely difficult to control the pressure at which the bottom plug is released and even more difficult to control the pressure at which the top plug is released. One very serious problem is when the pressure which has to be applied to release the bottom plug is so high that the top plug is simultaneously released thus severely delaying the cementing operation. Certain prior art sub-sea cementing apparatus is constructed primarily of aluminum and uses a multiplicity of shear pins to achieve release at desired pressures.

It is believed that aluminum is not the most suitable for certain sub-sea plug sets. Without wishing to be bound by any theory, the inventors believe that when existing sub-sea cement apparatus are maneuvered into position, relative movement between the parts of the apparatus causes small indentations in the surface of the aluminum which can form abutments which inhibit subsequent relative movement of parts at the desired pressure. Furthermore, the inventors believe that since, in practice, the fluid used during circulation often contains traces of sand and minute particles, these particles often become wedged between the parts of the apparatus, piercing or damaging the surface of the aluminum, and inhibiting relative movement of the parts.

Representative plug sets, plug containers, and release systems are shown in these U.S. Pat. Nos.: 5,392,852; 5,095,980; 5,004,048; 4,453,745; 4,433,859; 4,427,065; 4,290,482; 4,246,967; 4,164,980; 3,863,716; 3,635,288; 3,616,850; 3,545,542; and 2,620,037.

SUMMARY OF THE PRESENT INVENTION

The present invention, in one embodiment, discloses a well cementing system including a plug container with a flow diverter to direct fluid flow away from plugs therein; a swivel equalizer to isolate a plug set system from torque on drill pipe above the plug set system and to relieve fluid pressure above the plug set system; and a plug set system including a top cementing plug, a bottom cementing plug, and apparatus for releasably holding them and releasably holding them together. Such a system is usable with typical float equipment, float shoes, or float collars. In one aspect a single plug is used rather than a set of plugs.

The present invention provides in certain embodiments a sub-sea cementing apparatus which includes a bottom plug having an opening therein, a top plug having an opening therein, and apparatus for releasably holding the bottom plug and the top plug together: the top plug, the bottom plug and the apparatus made from a resilient material. In certain embodiments the resilient material is a plastic material; a fiberglass material; a combination thereof; or any easily drillable material, including but not limited to an easily drillable metal material or an easily drillable non-metal material.

It is, therefore, an object of at least certain preferred embodiments of the present invention to provide:

New, useful, unique, efficient, nonobvious devices and methods for wellbore cementing operations;

New, useful, unique, efficient, and nonobvious plugs and plug set systems for wellbore operations;

Such a plug or plug set system in which substantially all or all parts are made of easily drillable metal or non-metal material, in one aspect, plastic or fiberglass;

New, useful, unique, efficient, and nonobvious swivel equalizers for wellbore operations and, in one particular aspect, for use with plug set systems; and New, useful, unique, efficient and nonobvious plug or dart containers for holding and selectively releasing a dart or darts, or a plug or plugs into a wellbore which, in one aspect, have a flow diverter to divert fluid flow away from a dart or darts, or a plug or plugs in the container.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
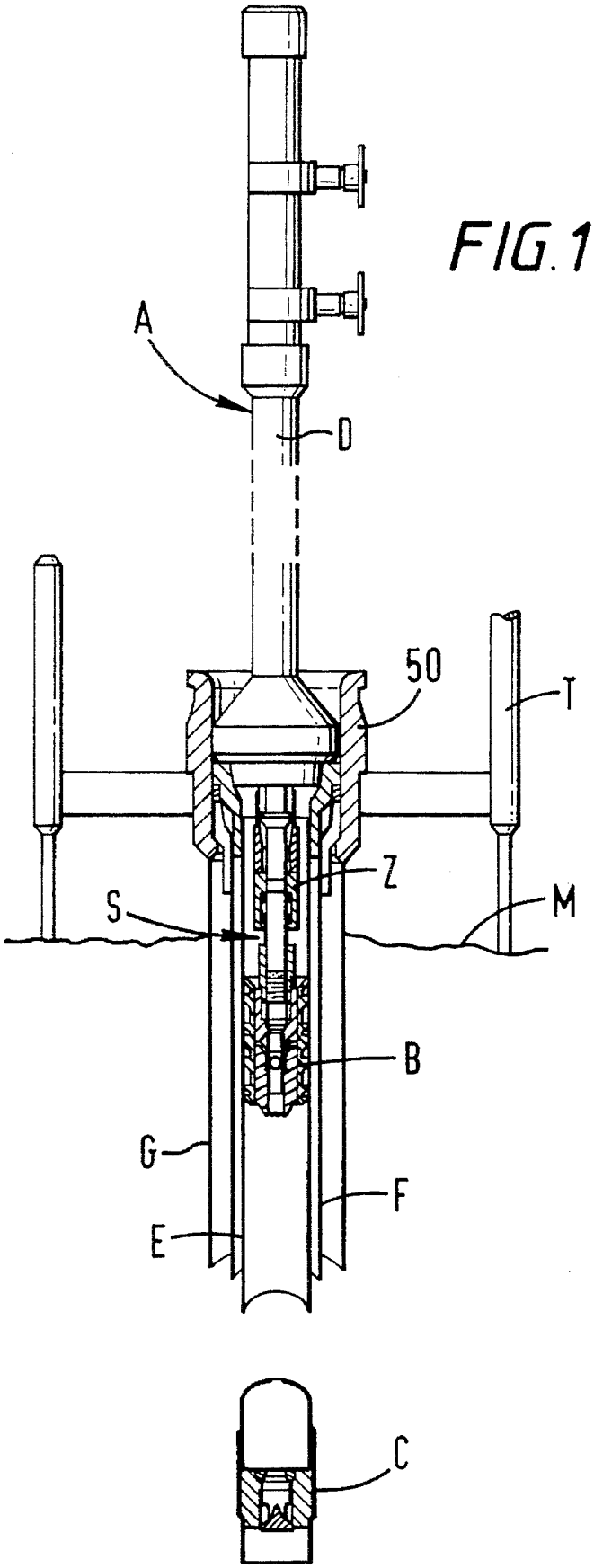
FIG. 1 is a side view in cross-section of a cementing system according to the present invention.

FIG. 1 illustrates a cementing system S according to the present invention which includes a plug container system A according to the present invention; a swivel equalizer Z according to the present invention; and a plug set system B according to the present invention within an innermost casing E within an internal casing F in an outer casing G. Float equipment C (e.g. but not limited to, any known float equipment, float collar or float shoe) is mounted at the bottom of the casing. Drill Pipe D extends from the plug container system A, to and through a casing hanger 50 in a sub-sea template T at the mud line M. In one embodiment the float equipment is as described in pending U.S. application Ser. No. 08/215,095 filed Mar. 18, 1994 entitled "Valve"; and in one embodiment the float equipment is as described in pending U.S. application Ser. No. 08/283,404 filed Aug. 1, 1994 entitled "Fill Valve". Both these applications are co-owned with the present invention and are incorporated fully herein for all purposes.

Figure 2:
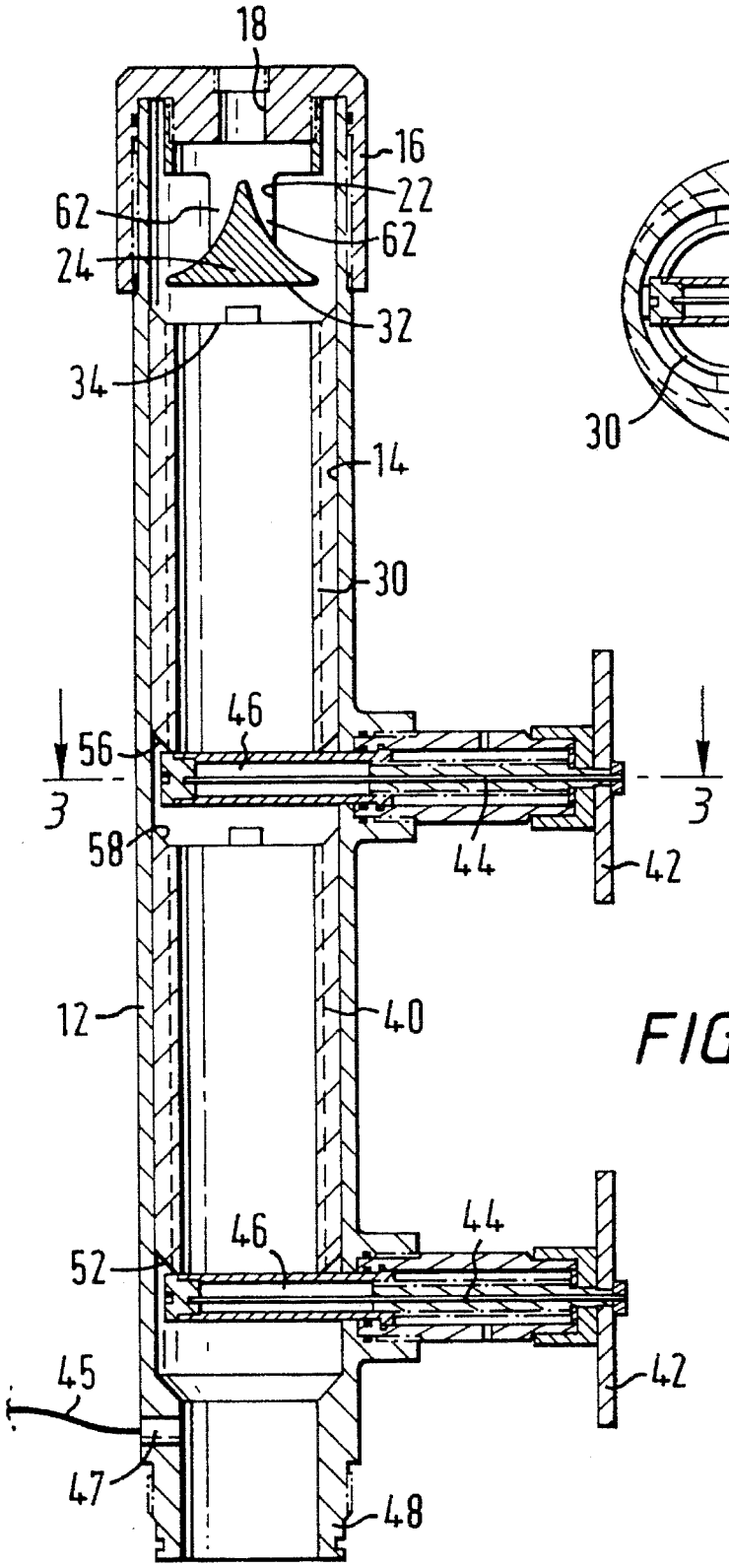
FIG. 2 is a side view in cross-section of a plug container according to the present invention.
Figure 3:
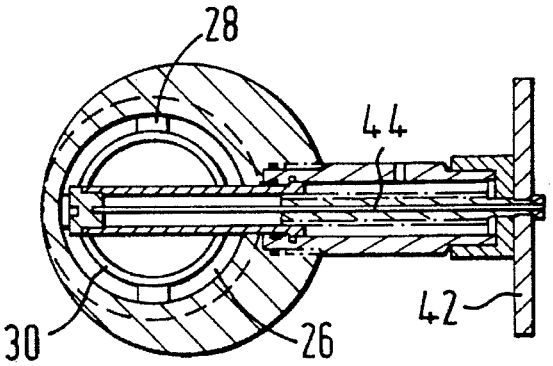
FIG. 3 is a top cross-section view along line 3—3 of FIG. 2.
Figure 4A:
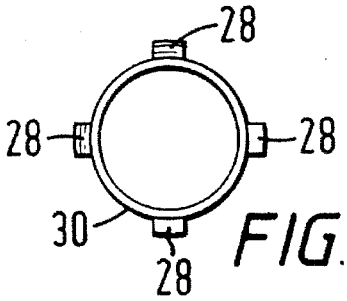
FIG. 4*a* is a top view of a spool of the device of FIG. 2.
Figure 4B:
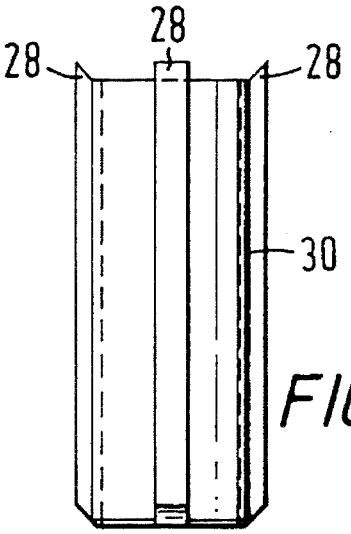
FIG. 4*b* is a side view of the spool of FIG. 4*a*.
Figure 5A:
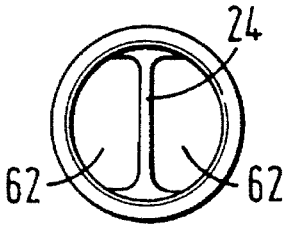
FIG. 5*a* is a top view of a diverter of the device of FIG. 2.
Figure 5B:
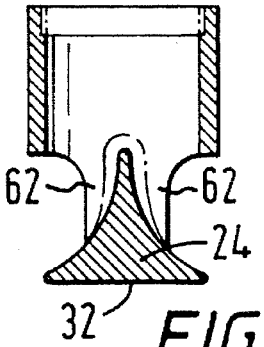
FIG. 5*b* is a side view in cross-section of the diverter of FIG. 5*a*.

FIG. 2 shows a plug container A which has a main body 12 with a bore 14 therethrough and a top cap 16 with a bore 18 therethrough. Fluid, e.g. displacement fluid, is flowable through the bore 18 of the cap 16 to enter into a bore 22 of a fluid diverter 20. The fluid contacts a diverter body 24 which directs the fluid away from the center of a top spool 30 and into spaces 26 between ribs 28 of the top spool 30 (see FIG. 3) and the interior surface of the container. The top spool 30 holds a top dart (not shown in FIG. 2) for selective release and movement downhole to activate a top plug as described below.

A bottom 32 of the diverter body 24 in certain preferred embodiments preferably extends across and above a substantial amount of an upper opening 34 of the top spool 30, most preferably above about 80% of the total opening area. Diverted fluid does not adversely impact or affect a dart disposed in the top spool 30 or in a bottom spool 40.

Darts in the spools are released by manually or automatically turning a handwheel 42 attached to an inner threaded shaft 44 which results in the extraction from within the body 12 of a plunger 46 which blocks downward spool movement. A crossover sub 48 may be used to interconnect the plug container A with drill pipe D (FIG. 1) or with some other tubular.

In certain embodiments the plug container A is provided with a sensor 47 which senses a dart or plug as it passes the sensor, generating a signal which is transmitted to associated apparatus to positively indicate dart or plug launch. In one aspect such a sensor is a magnetic sensor and an appropriate piece, insert, or band of magnetic material is applied on, around, or in the dart or darts, plug or plugs to be released from the container. In one aspect the sensor is disposed in or through the crossover sub 48 with appropriate wiring 45 extending therefrom to signal processing/display apparatus.

In operation, the bottom spool 40 is released by turning a handwheel 42 to remove a plunger 46 holding the spool in place. A lower sealing surface 52 of the bottom spool 40 moves to contact a sealing surface 54 of the crossover sub. Upon impact of spool 40 on the sealing surface 54, a bottom dart (not shown) in the spool 40 is released to move downhole to contact and co-act with a bottom plug of a plug set as described below. As and when desired, a handwheel 42 is turned to extract a plunger 46 which supports the top spool 30, permitting the top spool 30 to move down to impact the bottom spool 40, thereby releasing a top dart (not shown) to travel through the bottom spool to move downhole to contact and co-act with a top plug of a plug set as described below. A sealing surface 56 on a bottom of the top spool 30 seals against a sealing surface 58 on a top of the bottom spool 40.

Flow diversion by the diverter body 24 into windows 62 of the diverter 20 inhibits the creation of a fluid pressure overload on the plungers 46 and reduces the possibility of a premature dart launch. Overloading on the plungers 46 could distort them and/or inhibit their movement, thereby inhibiting or preventing dart release.

Figure 6:
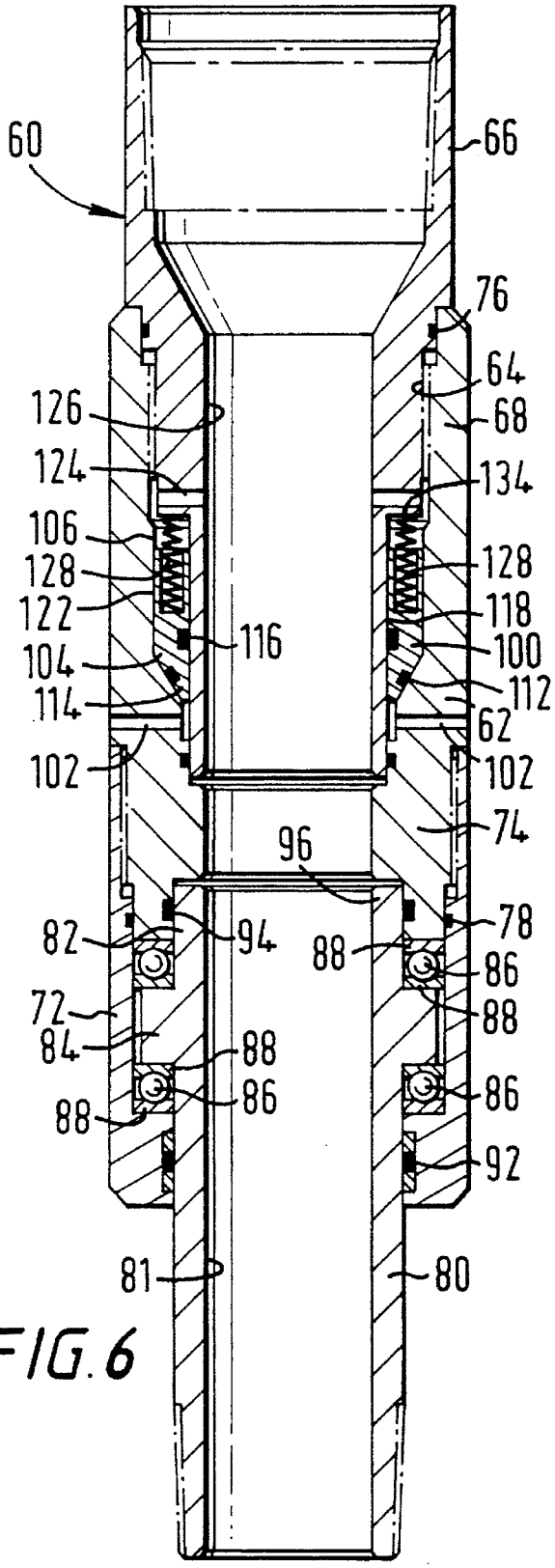
FIG. 6 is a swivel equalizer according to the present invention.

Connected to an end of the drill pipe D at one end and to a plug set system at the other end is the swivel equalizer Z according to the present invention. As shown in FIG. 6, in one embodiment the swivel equalizer Z is a swivel equalizer 60 with a middle body 62 with a bore 64 therethrough. A top sub 66 with a bore 126 therethrough is threadedly connected to a top end 68 of the middle body 62. A bearing housing 72 is threadedly connected to a bottom end 74 of the middle body 62. A seal 76 (e.g. O-ring) seals the interface between the top sub 66 and the middle body 62. A seal 78 seals the interface between the middle body 62 and the bearing housing 72. A pin sub 80 is rotatably mounted with a top end 82 within the bearing housing 72 with a ring 84 which rides on ball bearings 86 mounted in bearing races 88. A seal 92 seals the interface between the pin sub 80 and the bearing housing 72. In one aspect the seal 92 includes an O-ring and a metal or Teflon™ backup member above and below the seal. A seal 94 seals the interface between a top 96 of the pin sub 80 and the middle body 62. The pin sub 80 has a bore 81 and interconnects with a plug set system B below the pin sub 80 so that the plug set B is isolated from torque imposed on the swivel equalizer 60 since the pin sub 80 is free to rotate within the bearing housing 72 on the ball bearings 86. The swivel equalizer may be used with any other device, apparatus, or tool in a wellbore or in a tubular and/or on coiled tubing, including, but not limited to, use with a liner hanger. Darts are movable down through the swivel equalizer 60—through the bore 126, the bore 64, and a bore 81—to contact and co-act with plugs of a plug set system.

Figure 7:
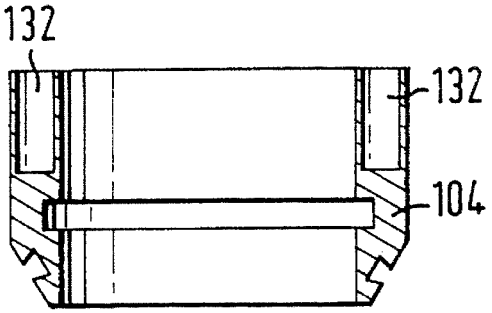
FIG. 7 is a side cross-section view of a valve member of the device of FIG. 6.
Figure 8:
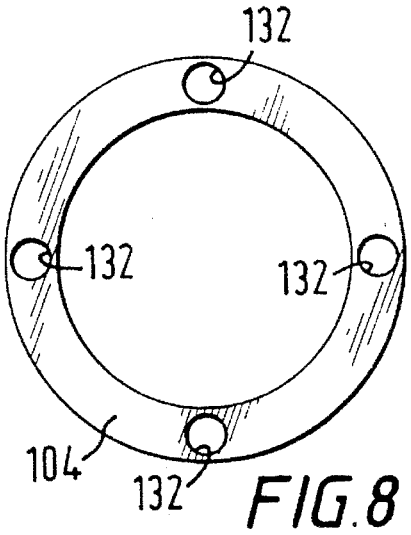
FIG. 8 is a top view of the valve member of FIG. 7.

To relieve and/or equalize the pressure of fluid above and/or adjacent the plugs of a plug set such as plug set B, (e.g. in the event a high pressure fluid is trapped by fins of the plugs which could force the plugs apart and result in a premature release) such trapped fluid under pressure flows through a port (or ports) 102 to contact a valve member 104 of a valve 100 disposed in a chamber 106 defined by an exterior surface 118 of a bottom 108 of the top sub 66 and an interior surface 122 of the middle body 62. A seal 112 which sealingly abuts an inner surface 114 of the middle body 62 is, in one embodiment larger than a seal 116 which sealingly abuts the surface 118 of the bottom 108 of the top sub 66 so that, when the pressure of fluid flowing into the port 102 is at a sufficient level, e.g. about 10 p.s.i. or greater, the valve member 104 is moved upwardly permitting the fluid to flow from above the plugs past the valve member 104, to and through a port 124, and into the bore 126 of the top sub 66. Initially springs 128 oppose the pressure of fluid (e.g. drilling mud, circulating fluid, wash fluid, completion fluid) flowing into the port 102 and prevent the valve member 104 from moving. As shown in FIGS. 7 and 8 the springs 128 are disposed in holes 132 in the valve member 104. Tops of the springs 128 abut a shoulder 134 of the top sub 66. Fluid flowing in the opposite direction will push on the valving member and flow through the port 102 will be shut off. Use of such a swivel equalizer allows the casing hanger to be made up without rotating the plugs inside the casing.

Figure 10:
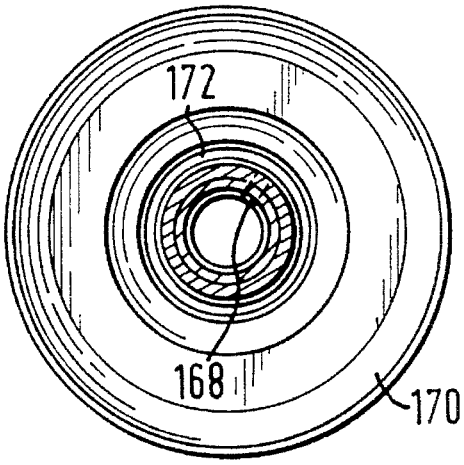
FIG. 10 is a cross-section view along line 10—10 of FIG. 9.
Figure 9:
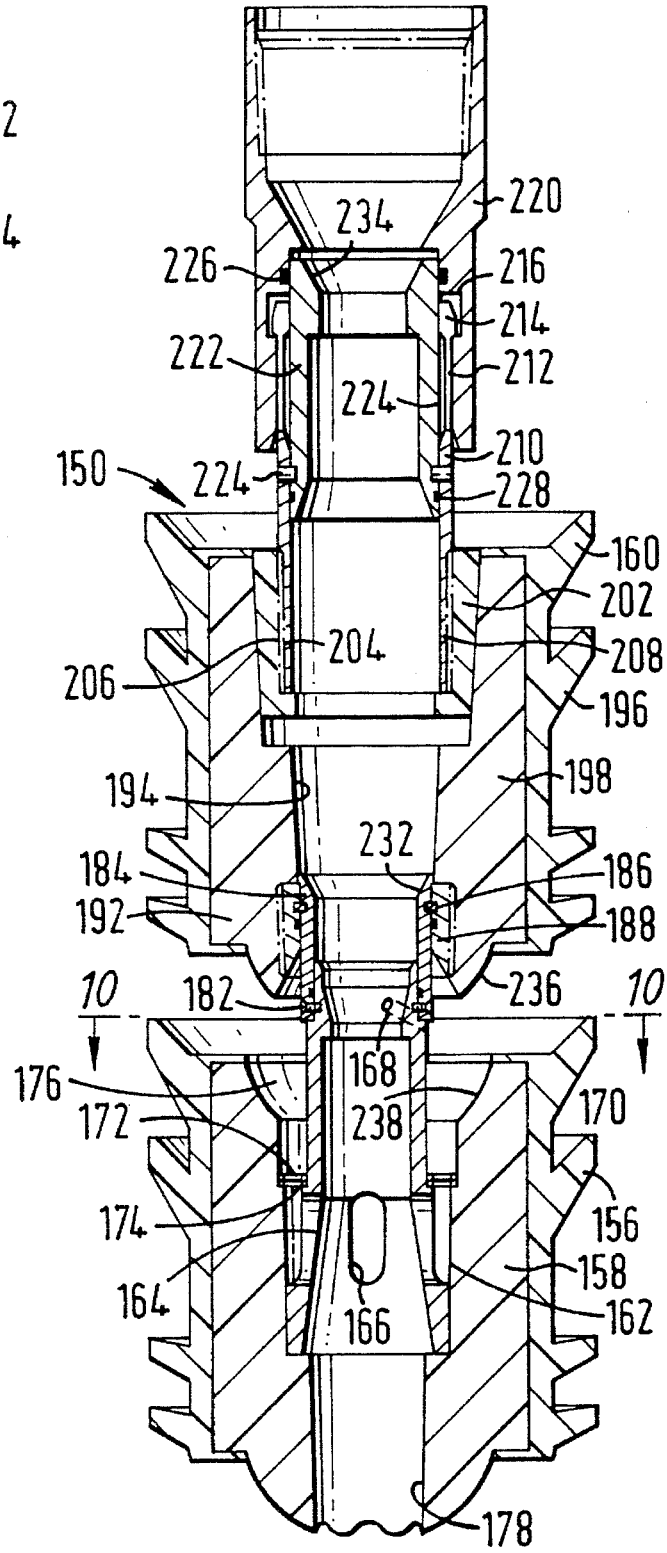
FIG. 9 is a side cross-section view of a plug set system according to the present invention.

FIGS. 9 and 10 show a plug set 150 with a top plug 160 and a bottom plug 170 which is one embodiment of a plug set B (FIG. 1) according to the present invention.

The bottom plug 170 has a finned exterior 156, a core 158, and a bore 162 therethrough. Disposed in the bore 162 is a flow piece 164 with one or more fluid flow windows 166 therethrough. The flow piece 164 has a pressure equalization hole 168 extending from the flow piece interior bore to the plug exterior for equalizing fluid pressure, if necessary, for fluid trapped by or between the two plugs. (Such a hole or holes may be provided for any plug or plug set according to this invention.) A burstable doughnut seal 172 is disposed on a shoulder 174 of the plug 170. Initially the seal 172 prevents fluid from flowing through a top bore 176 of the plug 170 to the windows 166 and thence out through a bottom opening 178 of the plug 170.

The flow piece 164 is shear pinned by shear pins 182 to a connector 184 which is secured by a shearable lock ring 186 to an insert 188 (made, in one aspect, of aluminum). The insert 188 is threadedly secured in a lower portion 192 of a bore 194 of the top plug 160. The lock ring 186 shears in response to the top plug 160 landing on the bottom plug 170.

The top plug 160 has a finned exterior 196 and an inner core 198 through which extends the bore 194. A core piece 202 (made, in one aspect, of plastic) is secured in a core 198 (e.g. by glue, other adhesives, a friction fit, ultrasonic welding or a threaded mating of the two pieces) and has a bore 204 therethrough and a threaded interior surface 206 for threadedly mating with a lower end 208 of a collet member 210. The collet member 210 (e.g. made of aluminum or plastic) has one or more (in one embodiment eight) collet fingers 212 with tips 214 held in a recess 216 in a top sub 220. A releasing sleeve 222 within a bore 224 of the top sub 220 prevents the collet fingers 212 from moving inwardly which prevents the collet member from being released from the top sub 220, thereby preventing the top plug 160 from being released from the top sub 220. The releasing sleeve 222 is shear pinned to the collet member 210 by one or more shear pins 224 which, in one embodiment, shear at e.g. about 2400 to about 2600 p.s.i. pressure. A seal 226 seals the interface between the releasing sleeve 222 and the top sub 220. A seal 228 seals the interface between the releasing sleeve 222 and the collet member 210.

In operation a bottom dart (not shown in FIG. 9) is released from a plug container A and travels down through the drill pipe D, through the swivel equalizer 60, through the top sub 220, through the releasing sleeve 222, and through the top plug 160, so that a tail portion of the bottom dart sealingly seals against a seal surface 232 of the connector 184. As subsequent fluid pressure builds up on the bottom dart, the pressure reaches a sufficient level (e.g. about 1500 to about 1700 p.s.i. pressure) to effect shearing of the lock ring 186, thereby effecting release of the bottom plug 170 from the top plug 160. The bottom plug 170 once freed, moves down hole typically ahead of cement to contact and co-act with the float equipment C. In order to flow fluid, e.g. cement out through the bottom plug 170 and through the float equipment C up into an annulus between an interior wellbore surface and an exterior of a tubular in which the float equipment is mounted, the fluid is pumped with sufficient pressure to burst the seal 172 (e.g. about 400 p.s.i. pressure), permitting fluid to flow down through the bore 176, to and through the windows 166, out through the bottom opening 178, and into the float equipment C.

To release the top plug 160 to plug the bottom plug 170 and stop cement flow, a top dart is released (e.g. from a top spool in the device of FIG. 2) which moves down so that its nose contacts and sealingly abuts a seal surface 234 on the releasing sleeve 222. When fluid pressure on the top dart reaches a desired level (e.g. about 2400 to about 2600 p.s.i. pressure) the shear pins 224 holding the releasing sleeve 222 to the collet member 210 are sheared and the releasing sleeve is pushed down by the top dart thereby freeing the collet fingers 212 for inward movement which results in the release of the top plug 160 from the top sub 220. The top plug 160 then moves down to contact the bottom plug 170. A nose 236 of the top plug 170 contacts and sealingly abuts a corresponding recess 238 in a top of the bottom plug 160. Preferably all or substantially all of the bottom dart (a "tail operated dart") is received within the bottom plug.

In certain preferred embodiments anti-rotation apparatus is used on plugs and/or float equipment according to this invention so that one does not rotate on and/or with respect to the other. In one aspect the plugs have corrugated noses and corresponding mating corrugated recesses for sealingly and non-rotatively mating with a corresponding corrugated nose; and float equipment has a corresponding corrugated mating recess like those disclosed in U.S. Pat. No. 5,390,736 issued on Feb. 21, 1995, entitled "Anti-Rotation Devices For Use With Well Tools," and co-owned with the present invention.

Figure 11:
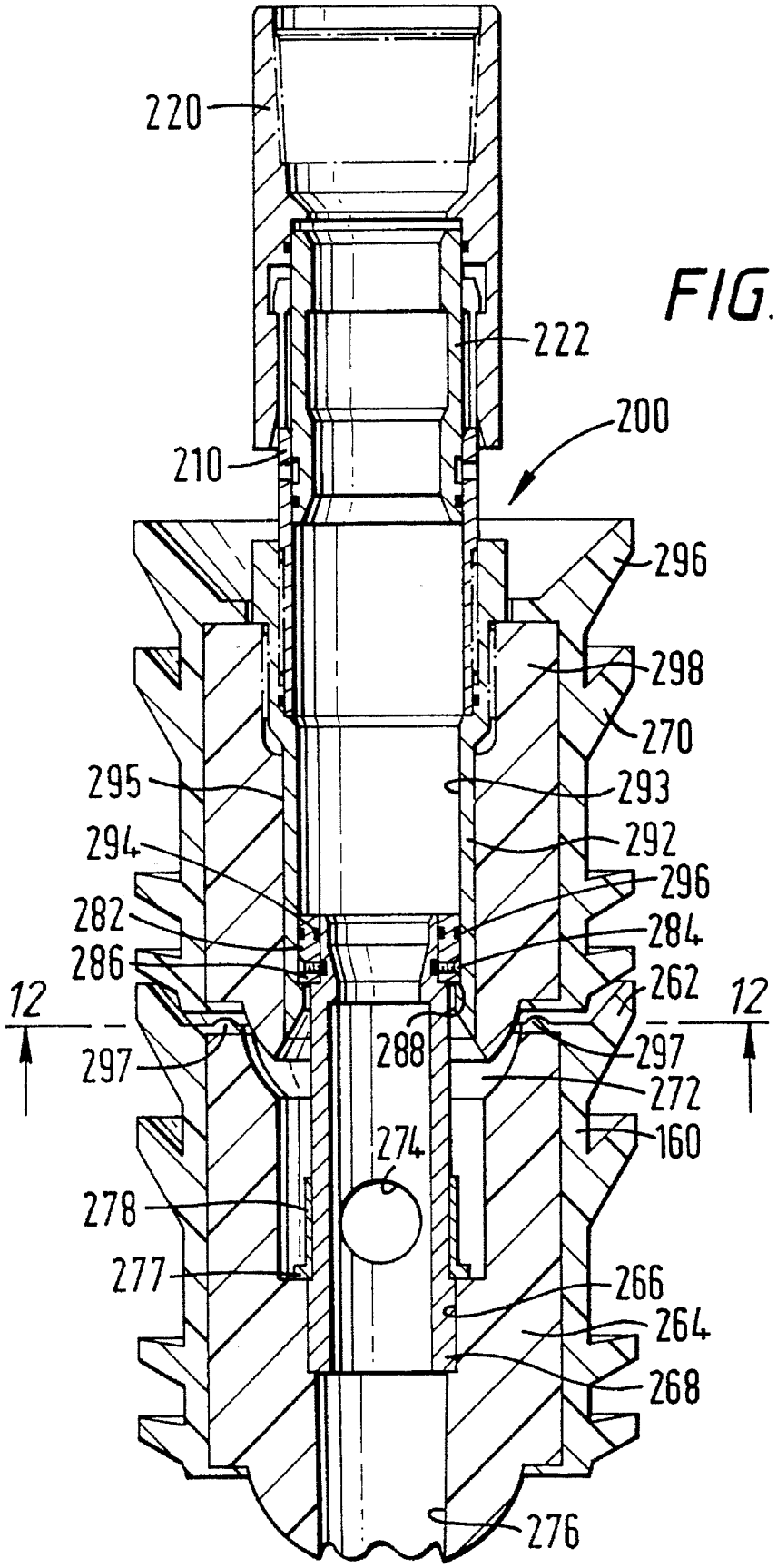
FIG. 11 is a side cross-section view of a plug set system according to the present invention.
Figure 12:
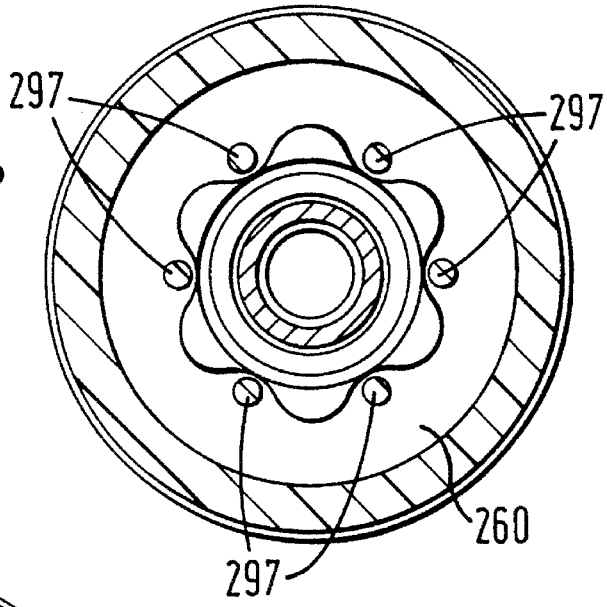
FIG. 12 is a top cross-section view along line 12—12 of FIG. 11.

FIGS. 11 and 12 disclose a plug set 200 similar to that of FIG. 9; but with various differences. A bottom plug 160 has a finned exterior 262; a core 264; a bore 266; and an inner flow piece 268. Initially fluid is prevented from flowing through a top bore 272 of the plug 260, to the bore 266, through one or more windows 274 in the flow piece 268, and out from a bottom opening 276 by a burstable tube 278 which blocks the window(s) 274. The tube 278 may be glued to the flow piece 268 or it may be held in place by a friction fit. A lower shoulder 277 on the burstable tube 278 facilitates proper emplacement of the tube 278. In other aspects the flow piece 268 is made as a single integral piece with a thinner and/or weakened area located at the desired location or locations for a window or windows.

The flow piece 268 (and hence the bottom plug 260) is releasably secured to a ring 282 by shear pins 284 which shear at, e.g. about 1500 to about 1700 p.s.i. pressure. The ring 282 has a lower end 286 which abuts an inner shoulder 288 of a core piece 292 (made of aluminum in one embodiment or of plastic in another). A seal 294 seals the interface between the flow piece 268 and the ring 282. A seal 296 seals the interface between the ring 282 and the core piece 292. In one aspect no glue is used on this plug set and all major parts are screwed together. The ring 282 is free floating in a bore 293 of the core piece 292. This facilitates swallowing by the top plug of a portion of the flow piece projecting from the bottom plug after the bottom plug is landed on float equipment. No part of the plug set moves (once the bottom plug is landed on the float equipment) for correct operation. The burstable tube bursts inwardly so that fluid flow downwardly is not impeded by tube parts projecting outwardly.

The core piece 292 is secured in a bore 295 of a top plug 270. The top plug 270 has a finned exterior 296 and a core 298. This embodiment employs the same collet member 210, releasing sleeve 222, and top sub 220 as the apparatus of FIG. 9.

FIG. 12 illustrates a plurality of spacer knobs 297 (e.g. soft rubber, polyurethane, or other flexible material) extending upwardly from the bottom plug 260 to initially maintain plug separation and prevent the two plugs from being in such close contact that a vacuum is formed between them which inhibits or prevents their separation (thereby preventing their launching).

Figure 14:
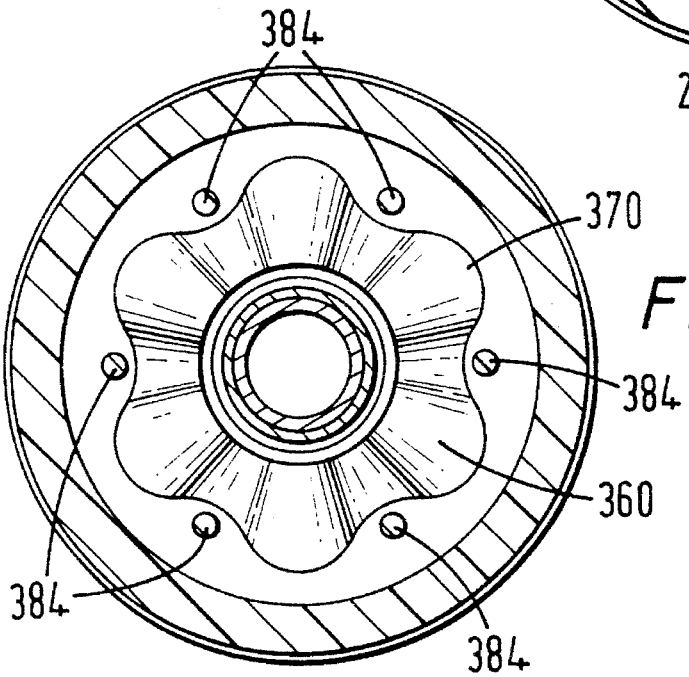
FIG. 14 is a top cross-section view along line 14—14 of FIG. 13.
Figure 13:
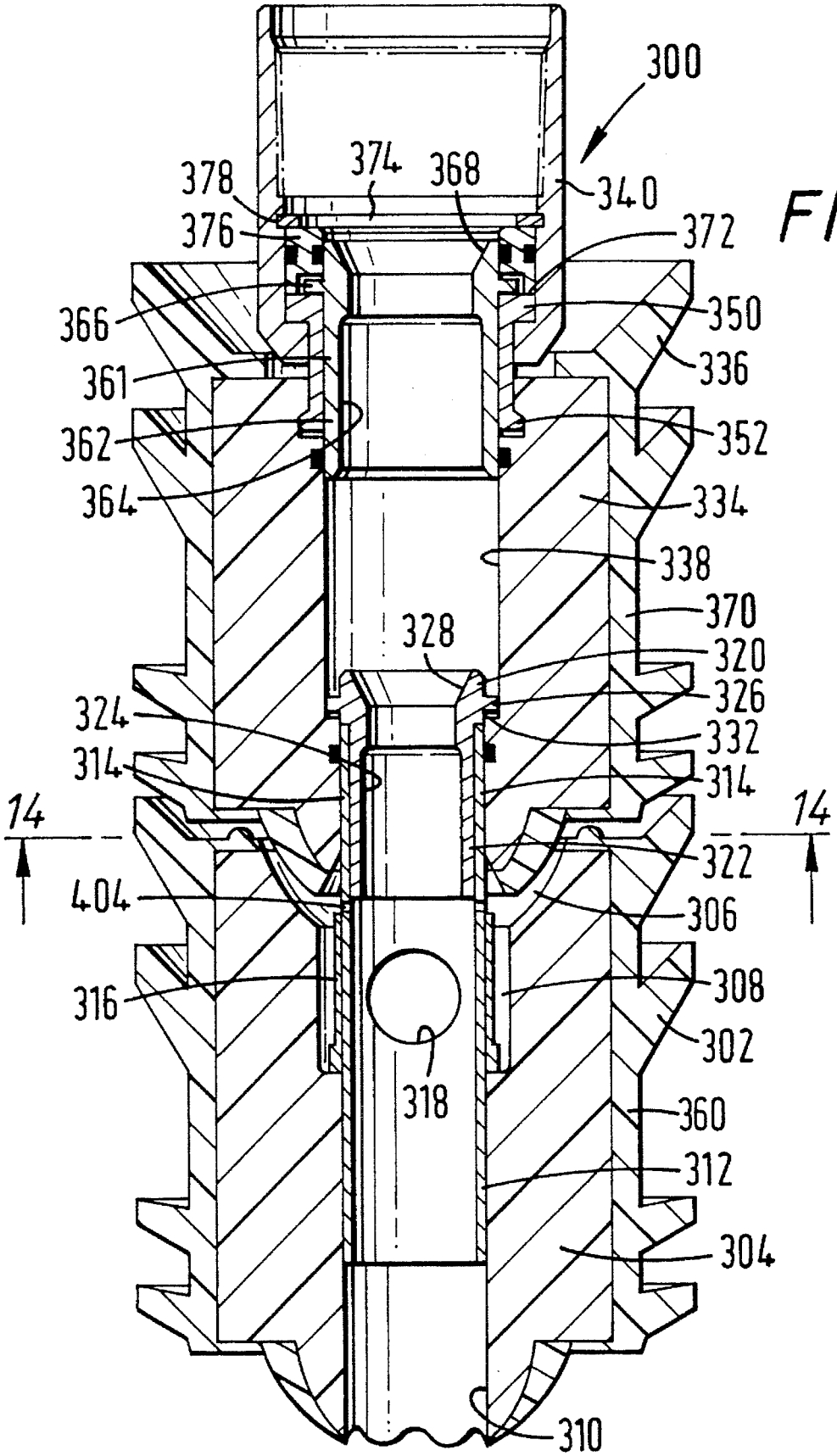
FIG. 13 is a side cross-section of a plug set system according to the present invention.

FIGS. 13 and 14 illustrate a plug set 300 according to the present invention which is useful as the plug set B in the system of FIG. 1. The plug set 300 has a bottom plug 360 with a finned exterior 302, a core 304, a top bore 306, a mid bore 308 and a lower bore 310. A flow piece 312 is secured in the bore 308 and/or to the flow piece 312 and a top portion 314 of the flow piece 312 is secured to a bottom dart receiver 320 which is initially disposed in a top plug 370. A burstable tube 316 initially prevents fluid from flowing through one or more windows 318 in the flow piece 312. The tube 316 may be glued to the flow piece 312 or it may be a friction fit over it. The windows may be of any desired shape (rectangular, oval, square, circular, etc.) and positioned as desired on the flow piece.

The bottom dart receiver 320 has a body 322, a bore 324, a shear ring 326 and a seal surface 328. The shear ring 326 initially rests on an inner shoulder 332 of a core 334 of a top plug 370. The plug 370 has a finned exterior 336 and bore 338.

The top plug 370 is releasably held to a top sub 340 by a collet member 350. A releasing sleeve 361 initially prevents collet fingers 352 from moving inwardly to release the top plug 370 from the top sub 340. The releasing sleeve 361 has a body 362, a bore 364, a shear ring 366, and a seal surface 368. The shear ring 366 rests on a top surface 372 of the collet member 350. A lock ring 374 in a groove 378 in a top sub 382 holds in place a holding ring 376 which holds the collet member 350 in place.

As shown in FIG. 14, spacer knobs 384 (e.g. made of soft plastic) maintain a minimum space between the two plugs to prevent vacuum formation therebetween.

Figure 15:
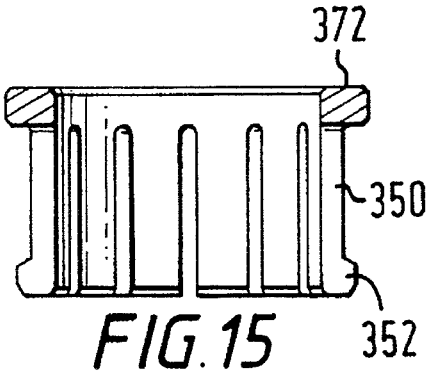
FIG. 15 is a side cross-section view of a collet member of the device of FIG. 13.
Figure 16:
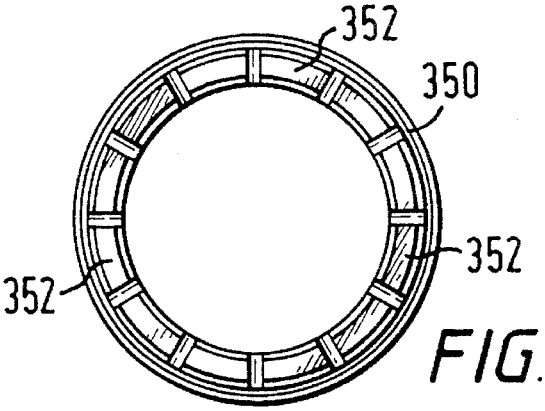
FIG. 16 is a bottom view of the device of FIG. 15.

In one embodiment the collet member 350 is a single piece member with a plurality of collet fingers 352 (see FIGS. 15, 16) which remains in the top sub rather than going down with the top plug. A clearance space 327 between a lower surface of the fingers and a shoulder 329 of the core 334 provide space in which the collet fingers move inwardly from the core 334. Due to an angled surface 331 on the core 334 and a corresponding angled surface 333 on the collet fingers 352, downward motion of the top plug 370 results in an inward force on the collet fingers 352 once the releasing sleeve 361 moves to free the collet fingers 352. In one aspect the collet member is made so that the collet fingers are biased inwardly. The releasing sleeve 361 may have a knife edge 363 at the lower end of the body 362 to cut a portion of a dart, e.g. a rear fin.

Figure 17:
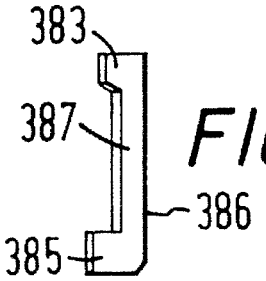
FIG. 17 is a side cross-section view of a collet member according to the present invention.
Figure 18:
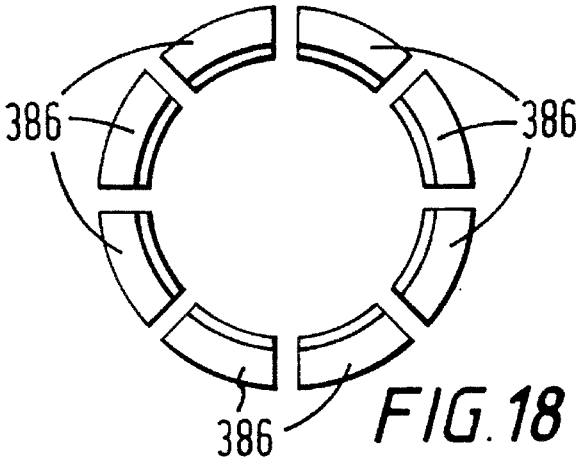
FIG. 18 is a top view of a plurality of collet members as in FIG. 17 in place in the device of FIG. 13.

In one aspect instead of integral shear rings (like the rings 326 and 366), it is within the scope of this invention to either adhere shear rings (of any cross-section, e.g. but not limited to circular, oval, square, rectangular, etc.), to a releasing sleeve's or dart receiver's exterior, or to provide a groove therein for receiving and holding a shear ring. In another embodiment, the collet member 350 is comprised of a plurality of individual pieces or "dogs" 386 (see FIGS. 17, 18). In such an embodiment a plurality of radial spaced stepped keyways each accommodate separate and distinct dogs. Each dog 286 is generally C-shaped having a vertical portion 287, a lower radially extending portion 385 which extends into a recessed portion of its respective stepped keyway, and an upper radially extending position 383 which extends over an inwardly extending flange portion of a connector which is connected to a tool string (not shown). The dogs 386 are maintained in the radially spaced stepped keyways by a sleeve which is generally similar to the sleeve 361 but of slightly greater internal diameter.

Figure 19:
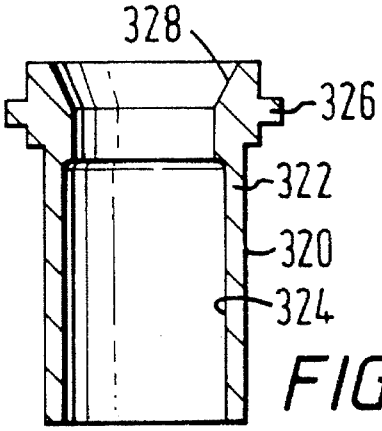
FIG. 19 is a side cross-section view of a bottom dart receiver of the device of FIG. 13.
Figure 20:
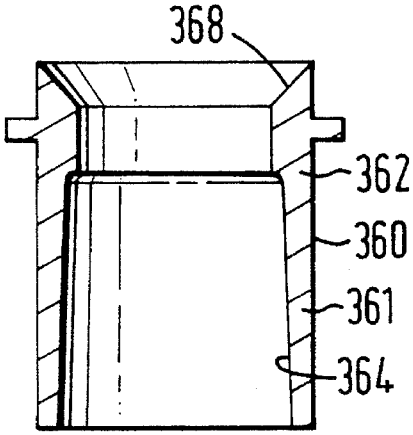
FIG. 20 is a side cross-section view of a top releasing sleeve of the device of FIG. 13.
Figure 21:
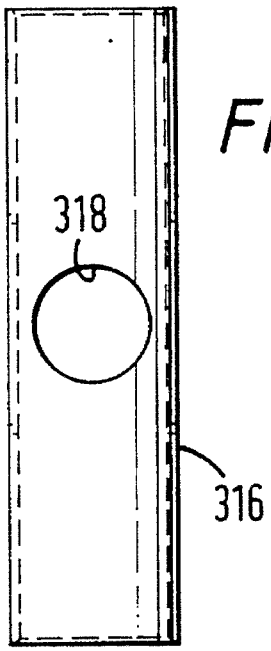
FIG. 21 is a side view of a flow piece of the device of FIG. 13.
Figure 22:
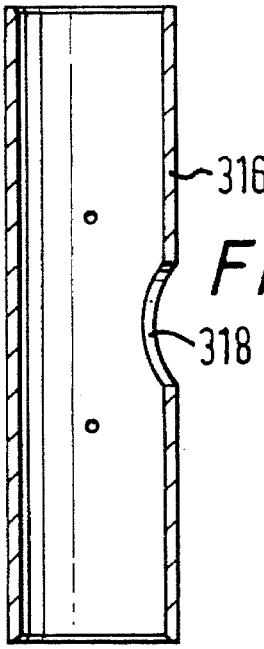
FIG. 22 is a side cross-section view of the flow piece of FIG. 21.
Figure 23:
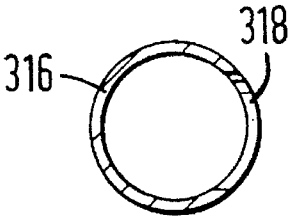
FIG. 23 is a top view of the flow piece of FIG. 21.

In one aspect such a system utilizes no shear pins, but relies on the use of the shear rings as described. In one embodiment the shear rings on the dart receivers are glued to the dart receivers. In one embodiment a bottom dart receiver 320 as shown in FIG. 19 has a shear ring which is formed integrally of the receiver body 322. In one aspect the bottom dart receiver is made of polycarbonate [e.g. LEXAN™ material] and the shear ring is about 2 millimeters thick. In one aspect the bottom dart receiver is made of Riton™ plastic and is about 3.5 millimeters thick. In one aspect the shear ring of the bottom dart receiver is designed, configured, and disposed to shear between 1500 and 1700 p.s.i. fluid pressure. In one aspect the releasing sleeve 360 (see FIG. 20) (which acts a top dart receiver) is made of Riton™ plastic and the integral shear ring is designed, configured, and disposed to shear between 2400 to 2600 p.s.i. fluid pressure. In one aspect a burstable tube (e.g. tubes 278, 316) is made of in one aspect about 2 millimeters thick "PPS" or polyphenylene sulphide, [Riton™ plastic is one commercial version of PPS.]

In operation, a tail operated bottom dart (or a ball may be used as with the other plug sets described above), lands on the bottom dart receiver; pressure builds up on the dart; and the shear ring of the bottom dart receiver is sheared allowing the bottom plug to move to the float equipment. The bottom plug lands on the float equipment and pressure builds up to a sufficient level to burst the bursting tube allowing cement to move to and through the float equipment to the annulus. The bottom dart receiver is glued to the flow tube and moves down with the bottom plug. Then when cement flow ceases, the "nose-operated" top dart is released shearing the shear ring on the releasing sleeve allowing the releasing sleeve to move down into the top plug, releasing the collet mechanism, and thereby releasing the top plug to move down to contact the bottom plug. The top plug swallows the flow tube extending upwardly from the bottom plug and, if used, anti-rotation apparatus on the two plugs goes into effect. A top fin of a bottom dart may be sheared at this time.

Figure 24:
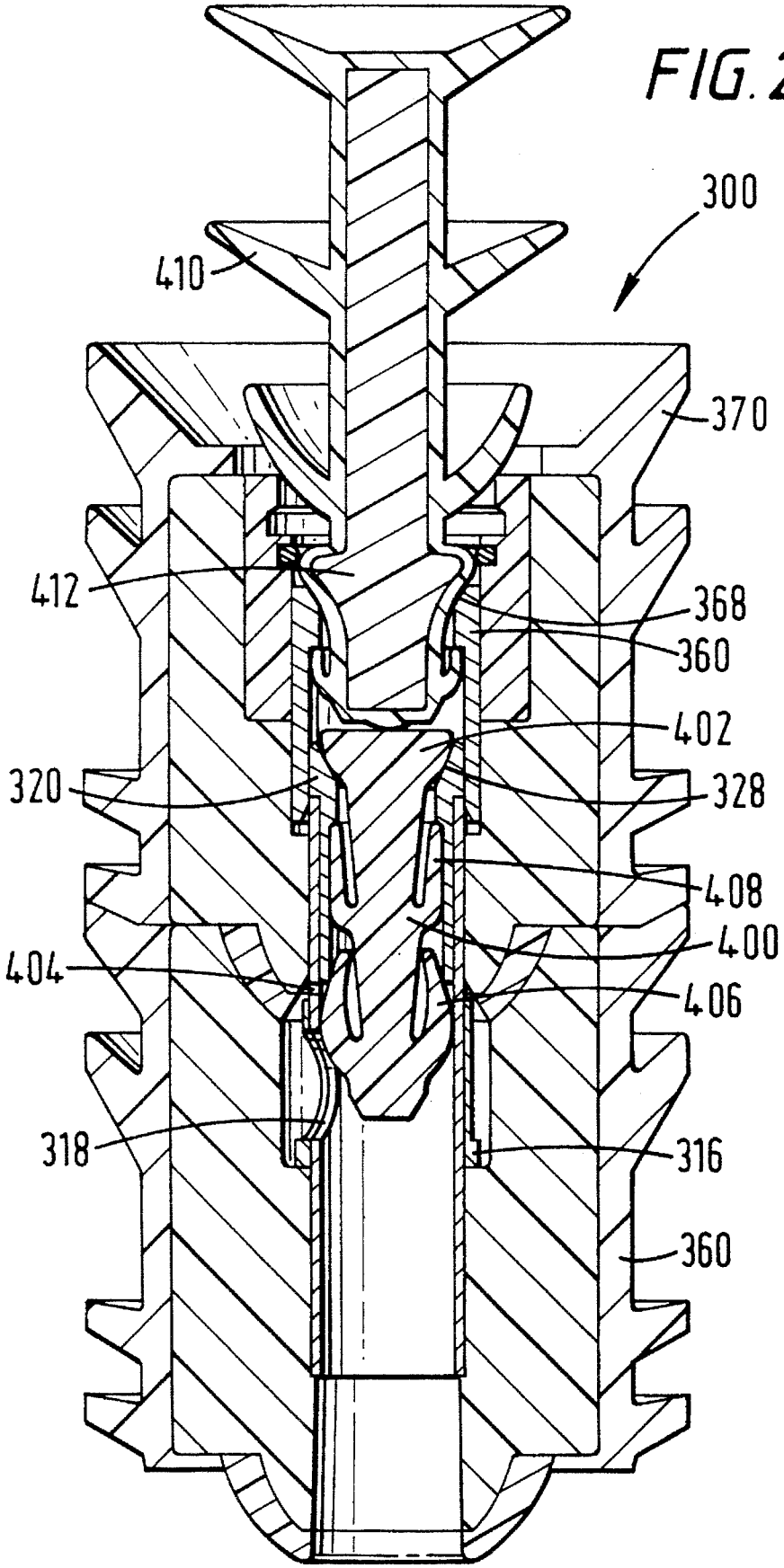
FIG. 24 is a side cross-section view of a plug set with darts according to the present invention.

FIG. 24 shows a plug set 300 according to the present invention post-launch; i.e., the plugs have been released from the plug container and are in position on top of float equipment C (not shown). A tail fin 402 of a bottom dart 400 has sealed against the seal surface 328 of the bottom dart receiver 320. The burstable tube 316 has burst inwardly at the window 318, opening it to fluid flow. The top plug 370 has been freed from the top sub and the plug 370 has moved to sealingly and anti-rotatively contact the bottom plug 360 (see, e.g. U.S. Pat. No. 5,390,736). A nose 412 of a top dart 410 has sealingly contacted the seal surface 368 of the releasing sleeve 360 and the sleeve 360 has moved down into the plug 370. As shown, a pressure equalization hole 404 through the flow piece 312 is effectively sealed by a bottom fin 406 and a top fin 408 so that flow out from the plug interior through the hole 404 is prevented.

Figure 25:
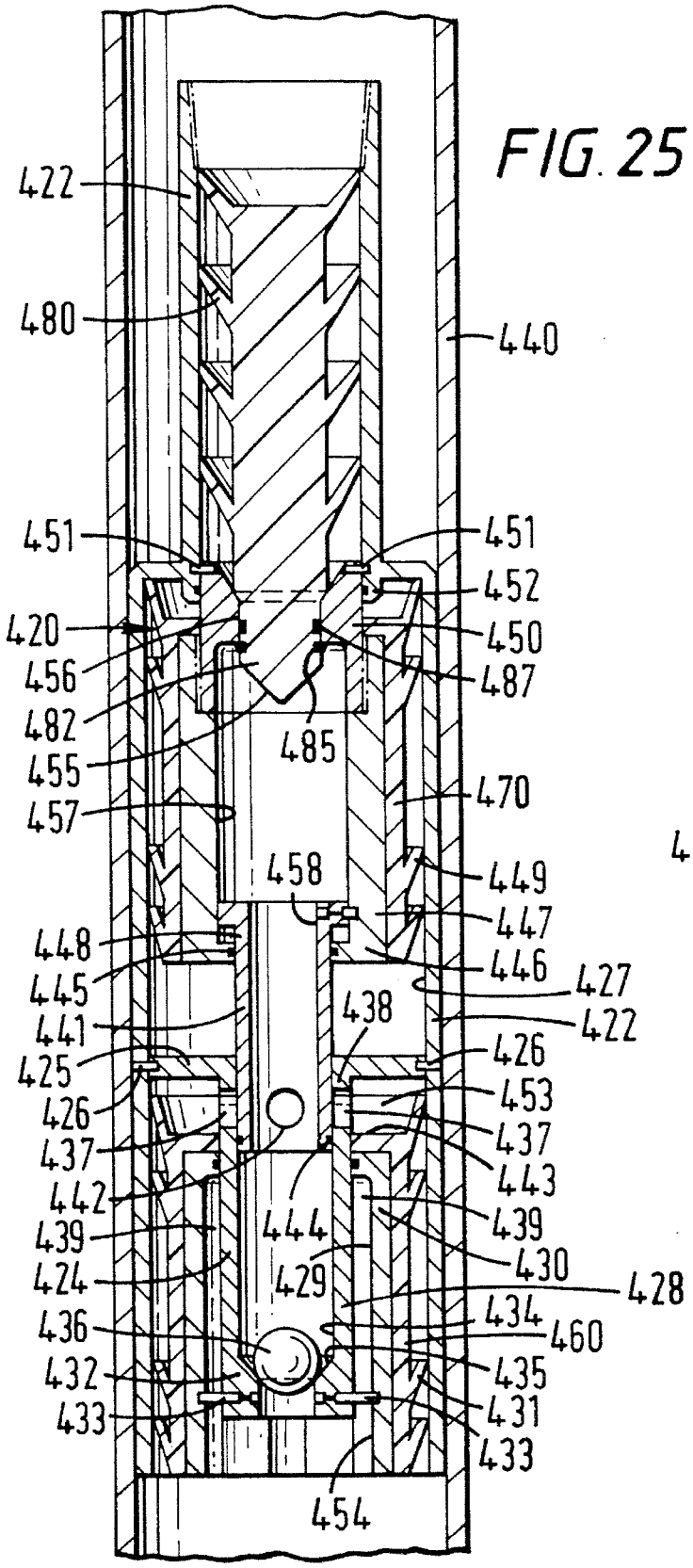
FIG. 25 is a side cross-section view of a plug set according to the present invention.
Figure 26:
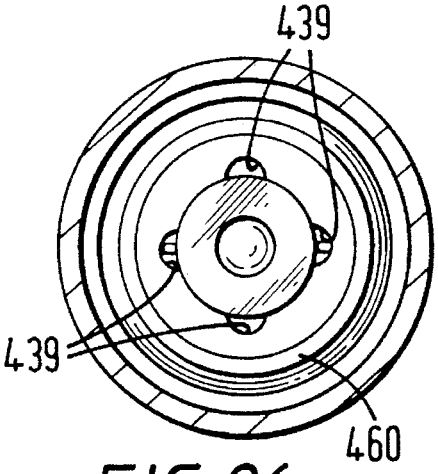
FIG. 26 is a cross-section view of a bottom plug of the plug set of FIG. 25.

FIGS. 25 and 26 show a plug set 420 according to the present invention with a bottom plug 460 and a top plug 470, each originally maintained in a plug holder or "can" 422 in casing 440. A bottom plug retainer 424 has a top plate 425 which is shear-pinned by pins 426 to an interior 427 of the can 422. The bottom plug retainer 424 has a descending cylindrical body 428 which extends down into a bore 429 of a core 430 of the bottom plug 460. The core 430 is within an outer finned structure 431 of the bottom plug 460. A lower portion 432 of the body 428 is shear-pinned by pins 433 to the core 430. An inner surface 434 of the body 428 has an inclined seal surface 435 suitable for sealingly contacting a ball 436 or a dart (not shown). Flow ports 437 are provided through an upper portion 438 of the body 428. Flow paths 439 are provided between an outer surface of the body 428 and an inner surface of the core 430.

A flow tube 441 with one or more flow windows 442 is disposed between the top plug 470 and the bottom plug 460.

The flow window(s) 442 are disposed so that flow is possible through the window(s) 442, through the ports 437 and into a space 453 between the top plate 425 and a top 443 of the bottom plug 460. An O-ring 444 seals an interface between the interior of the flow tube 441 and the bottom plug retainer 424. An O-ring 445 seals an interface between a core end 446 of a core 447 of the top plug 470 and an upper portion 448 of the flow tube 441. The top plug 470 has an outer finned structure 449. (It is to be understood that the present invention may be used with a plug or plug sets which have no outer fins or wipers or one or more outer fins or wipers.)

A top plug retainer 450 is shear-pinned by pins 451 to a top end 452 of the can 422. The top plug retainer 450 is secured in the core 447 of the top plug 470, e.g. by a tapered friction fit, but an adhesive, by mating threads, by ultrasonic welding, or some combination thereof.

As shown in FIG. 25, a ball 436 has been launched and landed on the seal surface 435 of the bottom plug retainer of the body 428. Fluid under pressure will then be pumped into the space 453. When sufficient pressure is reached, the shear pins 426 shear releasing the bottom plug 460 to more down the casing 440 to contact float equipment (not shown), leaving behind the flow tube 441. Upon landing and sealing of the bottom plug 460 on the float equipment, the pins 433 shear due to fluid pressure build-up, freeing the bottom plug retainer 424 to move downwardly so that the flow ports 437 move within the core 430 thereby opening a fluid flow path from above the bottom plug 460, through a bore 454 of the bottom plug retainer 424, through the ports 437, through the flow paths 439, and to and through the float equipment into the wellbore annulus.

Then a dart 480 is pumped down to the top plug 470 so that a nose 482 of the dart 480 seals against a seal surface 455 of the top plug retainer 450, closing off a flow bore 456 through the top plug retainer 450 and flow bore 457 through the top plug 470 and flow bore 458 through the flow tube 441. Fluid pressure build-up on the dart 480 shears the pins 451, releasing the top plug 470 to move down to seat and seal on the bottom plug 460 (with the flow tube 441 moved up into the top plug 470), to stop fluid flow up into the annulus. The can 422 may be located and secured at any point in the casing. In one aspect it hangs on a casing hanger. The plugs, plug retainers, and flow tube of the plug set 420 may all be made of plastic, of fiberglass, and/or easily drillable material; as also may be the can, ball(s), and/or dart(s) used therewith. Sealing O-rings 485, 487 are provided for the dart 480.

It is within the scope of this invention for any plug set according to this invention to be made (in its entirety or substantially all of it) of plastic, fiberglass, polytetrafluoroethylene, or any easily drillable metal (brass, beryllium, copper, copper-based alloy, zinc, zinc-based alloy) or non-metal material. It is within the scope of this invention to delete the bottom plug from any plug set disclosed or claimed herein to provide a single plug system. It is within the scope of this invention to make the top sub of any plug set disclosed or claimed herein (and any lock ring, such as the lock ring 374; any holding ring, such as the holding ring 376; and any collet member) of appropriate material (e.g. plastic, metal, fiberglass) so that these items are re-usable once they have been retrieved from a wellbore.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A plug holding device for releasably holding a plug to a plug holder, the plug holder having a holder bore and a holder recess around the holder bore, the plug holder having holding apparatus releasably holding a plug, the plug having a plug bore therethrough in fluid communication with the holder bore, the plug holding device comprising a tubular sleeve with a sleeve bore disposable in fluid communication with the holder bore, the tubular sleeve having an external lock ring therearound and projecting therefrom for reception in the holder recess, the tubular sleeve positionable for preventing release of the holding apparatus from the plug, and the external lock ring shearable in response to pressure on the tubular sleeve, the tubular sleeve movable upon shearing of the external lock ring to permit movement of the holding apparatus to release the plug.

2. The plug holding device of claim 1 wherein the tubular sleeve is movable away from the holding apparatus and with the plug upon shearing of the external lock ring.

3. The plug holding device of claim 1 wherein the external lock ring is formed integrally of the tubular sleeve.

4. The plug holding device of claim 1 wherein the tubular sleeve has an upper seal surface around a top opening of the sleeve bore, the upper seal surface suitable for receiving and sealing against another member contacting the upper seal surface.

5. A plug holding device for releasably holding a bottom plug to a top plug, the top plug having a top bore therethrough, the top bore having a shoulder, the bottom plug having a bottom bore therethrough, the plug holding device releasably securing the bottom plug to the top plug, the plug holding device comprising a tubular sleeve with a sleeve bore disposable in fluid communication with the top bore, the tubular sleeve having a lower portion secured to the bottom plug, the tubular sleeve having an external lock ring therearound and projecting therefrom, the external lock ring resting on the shoulder of the top bore thereby preventing release of the top plug from the bottom plug, and the external lock ring shearable in response to pressure on the tubular sleeve to release the bottom plug from the top plug.

6. The plug holding device of claim 5 wherein the tubular sleeve is movable with the bottom plug upon shearing of the external lock ring.

7. The plug holding device of claim 5 wherein the external lock ring is formed integrally of the tubular sleeve.

8. The plug holding device of claim 5 wherein the tubular sleeve has an upper seal surface around a top opening of the sleeve bore, the upper seal surface suitable for receiving and sealing against another member contacting the upper seal surface.

9. The plug holding device of claim 5 wherein the bottom bore has an upper portion and a lower portion, the upper portion larger in diameter than the lower portion and the plug holding device further comprising a tubular flow piece encircling a portion of the tubular sleeve in the top plug and extending down into the upper portion of the bottom bore, the tubular flow piece having at least one flow window therethrough disposed adjacent the upper portion of the bottom bore, and a burst tube disposed in the upper portion of the bottom bore and initially blocking off fluid flow through the at least one flow window, the burst tube burstable at the at least one flow window by fluid pressure thereon to permit fluid flow from above the bottom plug, through the at least one flow window and out from the upper portion of the bottom bore.

10. A plug set comprising a top plug, a bottom plug releasably secured to the top plug, releasing apparatus comprising a first plug holding device and a second plug holding device, the first plug holding device for releasably holding the top plug to a plug holder, the plug holder having a holder bore and a holder recess around the holder bore, the plug holder having holding apparatus for releasably holding the top plug, the top plug having a top bore therethrough in fluid communication with the holder bore, the first plug holding device comprising a first tubular sleeve with a first sleeve bore disposable in fluid communication with the holder bore, the first tubular sleeve having a first external lock ring therearound and projecting therefrom for reception in the holder recess, the first tubular sleeve positionable for preventing release of the holding apparatus from the top plug, and the first external lock ring shearable in response to pressure on the first tubular sleeve, the first tubular sleeve movable upon shearing of the first external lock ring to permit movement of the holding apparatus to release the top plug, the second plug holding device for releasably holding the bottom plug to the top plug, the top bore of the top plug having a shoulder, the bottom plug having a bottom bore therethrough, the second plug holding device releasably securing the bottom plug to the top plug, the second plug holding device comprising a second tubular sleeve with a second sleeve bore disposable in fluid communication with the top bore, the second tubular sleeve having a lower portion secured to the bottom plug, the second tubular sleeve having a second external lock ring therearound and projecting therefrom, the second external lock ring resting on the shoulder of the top bore thereby preventing release of the top plug from the bottom plug, and the second external lock ring shearable in response to pressure on the second tubular sleeve to release the bottom plug from the top plug.

11. The plug set of claim 10 wherein the first plug holding device further comprises the first tubular sleeve movable away from the holding apparatus and with the top plug upon shearing of the first external lock ring.

12. The plug set of claim 10 wherein the first plug holding device further comprises the first external lock ring formed integrally of the first tubular sleeve.

13. The plug set of claim 10 wherein the first plug holding device further comprises the first tubular sleeve having a first upper seal surface around a top opening of the first sleeve bore, the first upper seal surface suitable for receiving and sealing against another member contacting the first upper seal surface.

14. The plug set of claim 10 wherein the second tubular sleeve is movable with the bottom plug upon shearing of the external lock ring.

15. The plug set of claim 10 wherein the second external lock ring is formed integrally of the second tubular sleeve.

16. The plug set of claim 10 wherein the second tubular sleeve has a second upper seal surface around a top opening of the second sleeve bore, the second upper seal surface suitable for receiving and sealing against another member contacting the second upper seal surface.

17. The plug set of claim 10 wherein the bottom bore has an upper portion and a lower portion, the upper portion larger in diameter than the lower portion and the second plug holding device further comprising a tubular flow piece encircling a portion of the second tubular sleeve in the top plug and extending down into the upper portion of the bottom bore, the tubular flow piece having at least one flow window therethrough disposed adjacent the upper portion of the bottom bore, and a burst tube disposed in the upper portion of the bottom bore and initially blocking off fluid flow through the at least one flow window, the burst tube burstable at the at least one flow window by fluid pressure thereon to permit fluid flow from above the bottom plug, through the at least one flow window and out from the upper portion of the bottom bore.

18. The container of claim 10 wherein the flow diversion apparatus is a conical member with a bottom which extends across part of the bore.

19. The container of claim 10 further comprising the at least one plug releasably disposed in a spool within the body, the spool having a plurality of outwardly extending ribs and wherein the flow diversion apparatus directs fluid away from a center of the bore and into spaces between the spool's ribs and an interior of the body, and sensor apparatus interconnected with the body for sensing release of the at least one plug and generating a signal indicating said release.

20. A container for releasably containing at least one plug for insertion into a tubular member or wellbore, the container comprising a body with a bore therethrough, the body having a top end and a bottom end, each end of the body at an end of the bore, releasing apparatus interconnected with the body for selectively releasing at least one plug contained within the body so that the at least one plug moves downwardly and exits the body, and flow diversion apparatus disposed in the body above the at least one plug for directing fluid flowing into the top of the body away from the at least one plug.

* * * * *

UNITED STATES PATENT AND TRADEMARK OFFICE

CERTIFICATE OF CORRECTION

PATENT NO. : 5,553,667

DATED : Sept. 10, 1996

INVENTOR(S) : Budde et al

It is certified that error appears in the above-identified patent and that said Letters Patent is hereby corrected as shown below:

Col. 14, line 38, change ''10'' to --20--

Col. 14, line 41, change ''10'' to --20--

Signed and Sealed this

Fifteenth Day of September, 1998

*Attest:*

Bruce Lehman

BRUCE LEHMAN

*Attesting Officer*

*Commissioner of Patents and Trademarks*